US009919884B2

(12) United States Patent
Kurokawa et al.

(10) Patent No.: US 9,919,884 B2
(45) Date of Patent: Mar. 20, 2018

(54) SHEET CONVEYING DEVICE AND IMAGE READING APPARATUS

(71) Applicant: BROTHER KOGYO KABUSHIKI KAISHA, Nagoya-shi, Aichi-ken (JP)

(72) Inventors: Kotaro Kurokawa, Ichinomiya (JP); Hideaki Utagawa, Hadano (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/136,090

(22) Filed: Apr. 22, 2016

(65) Prior Publication Data

US 2016/0236884 A1 Aug. 18, 2016

Related U.S. Application Data

(63) Continuation of application No. 14/626,627, filed on Feb. 19, 2015, now Pat. No. 9,327,927.

(30) Foreign Application Priority Data

Feb. 21, 2014 (JP) ..... 2014-031722

(51) Int. Cl.
*B65H 3/68* (2006.01)
*B65H 3/06* (2006.01)
(Continued)

(52) U.S. Cl.
CPC ..... *B65H 3/0661* (2013.01); *B65H 3/5223* (2013.01); *B65H 5/062* (2013.01);
(Continued)

(58) Field of Classification Search
CPC ..... B65H 3/10; B65H 3/68; B65H 3/0661; B65H 3/0692; B65H 5/38;
(Continued)

(56) References Cited

U.S. PATENT DOCUMENTS 5,946,527 A 8/1999 Salgado et al.
7,889,400 B2 2/2011 Akiyama
(Continued)

FOREIGN PATENT DOCUMENTS

CN 102202158 A 9/2011
CN 102625012 A 8/2012
(Continued)

OTHER PUBLICATIONS

Office Action from corresponding Japanese Patent Application No. P2014-031722, dated Jan. 24, 2017.
(Continued)

*Primary Examiner* — Michael C McCullough
(74) *Attorney, Agent, or Firm* — Merchant & Gould P.C.

(57) ABSTRACT

A sheet conveying device includes a conveyor for conveying a sheet along a predetermined conveyance path and a feeder unit for supporting the sheet to be fed to the conveyor. The conveyor includes a first guide part for guiding the sheet toward a downstream side in the conveying direction in a direction inclined at a downward gradient, a second guide part for guiding the sheet from the first guide part toward a further downstream side in a direction inclined at an upward gradient, a suction roller arranged at the first guide part for conveying the sheet supported by the feeder unit toward the downstream side, and a first conveyance roller arranged at the second guide part and for conveying the sheet conveyed by the suction roller toward the downstream side one at a time.

10 Claims, 4 Drawing Sheets

(51) Int. Cl.

| | |
|---|---|
| ***B65H 3/52*** | (2006.01) |
| ***B65H 5/06*** | (2006.01) |
| ***B65H 5/38*** | (2006.01) |
| *B65H 3/10* | (2006.01) |

(52) U.S. Cl.
CPC ..... *B65H 5/38* (2013.01); *B65H 3/0692* (2013.01); *B65H 3/10* (2013.01); *B65H 2404/14211* (2013.01); *B65H 2404/6111* (2013.01); *B65H 2405/3321* (2013.01); *B65H 2801/06* (2013.01); *B65H 2801/39* (2013.01)

(58) Field of Classification Search
CPC ..... B65H 2405/3321; B65H 2801/39; B65H 2301/3122; B65H 2301/31124; G03G 15/60
USPC ..... 399/374
See application file for complete search history.

(56) References Cited

U.S. PATENT DOCUMENTS

| | | | | |
|---|---|---|---|---|
| 8,109,498 | B2 * | 2/2012 | Akimatsu | B65H 3/0684 271/10.01 |
| 8,251,363 | B2 | 8/2012 | Shingai | |
| 8,253,995 | B2 | 8/2012 | Mizutani | |
| 9,327,927 | B2 * | 5/2016 | Kurokawa | B65H 3/5223 |
| 2005/0254105 | A1 | 11/2005 | Muzzin et al. | |
| 2007/0109614 | A1 * | 5/2007 | Iwago | H04N 1/00572 358/498 |
| 2008/0080024 | A1 | 4/2008 | Ishido | |
| 2009/0168127 | A1 | 7/2009 | Hamada et al. | |
| 2009/0185243 | A1 | 7/2009 | Mizutani | |
| 2010/0245947 | A1 * | 9/2010 | Takeuchi | H04N 1/00525 358/498 |
| 2011/0233849 | A1 | 9/2011 | Shingai | |
| 2011/0235139 | A1 * | 9/2011 | Kurokawa | G03G 15/60 358/498 |
| 2011/0242622 | A1 | 10/2011 | Takeuchi et al. | |
| 2011/0242623 | A1 * | 10/2011 | Akimatsu | H04N 1/00546 358/498 |
| 2012/0195668 | A1 | 8/2012 | Yamamoto | |
| 2012/0292846 | A1 * | 11/2012 | Kotaka | B65H 3/5223 271/10.09 |

FOREIGN PATENT DOCUMENTS

| | | | |
|---|---|---|---|
| CN | 102785953 | A | 11/2012 |
| JP | 9-46472 | A | 2/1997 |
| JP | 11-136442 | A | 5/1999 |
| JP | 2005-333633 | A | 12/2005 |
| JP | 2007-166229 | A | 6/2007 |
| JP | 2008-048190 | A | 2/2008 |
| JP | 2009-164764 | A | 7/2009 |
| JP | 4818038 | B2 | 11/2011 |
| JP | 2012-24758 | A | 12/2012 |
| JP | 5126270 | B2 | 1/2013 |

OTHER PUBLICATIONS

Office Action issued in related Chinese patent application No. 201510087495.0 on Nov. 28, 2017.

* cited by examiner

SHEET CONVEYING DEVICE AND IMAGE READING APPARATUS

CROSS-REFERENCE TO RELATED APPLICATIONS

This application is a continuation of U.S. patent application Ser. No. 14/626,627 filed Feb. 19, 2015, and further claims priority from Japanese Patent Application No. 2014-031722 filed on Feb. 21, 2014, the entire contents of both of which are incorporated herein by reference.

TECHNICAL FIELD

The disclosure relates to a sheet conveying device and an image reading apparatus.

BACKGROUND

There has been disclosed a configuration of an image reading apparatus of an automatic document feeder (ADF) type configured to read an image of a document while conveying the document.

The above-described related-art image reading apparatus is configured to convey a plurality of documents supported on a sheet supply tray toward a downstream side in a conveying direction by a suction roller and to separate the documents one at a time by a separation roller. The separated document is further conveyed toward the downstream side in the conveying direction, is curved by a reverse roller forming a curved path and is conveyed toward a sheet discharge tray arranged below the sheet supply tray.

As described above, for the image reading apparatus of an ADF type, it is needed to increase a number of documents that can be collectively set on the sheet supply tray. In a configuration where the more number of documents can be set on the sheet supply tray, it is necessary to increase a diameter of a separation roller so as to appropriately separate the documents one at a time upon the conveyance.

However, when a conveyance path is located at an equivalent position, as a diameter of the separation roller arranged at an upper side with respect to the conveyance path is increased, an upper end of the separation roller is located at a more upward position. For this reason, it is difficult to reduce a height size of the part at which the separation roller is provided. As a result, it is difficult to make the image reading apparatus thin while increasing the number of documents to be collectively settable.

SUMMARY

Therefore, it is preferably to provide a sheet conveying device and an image reading apparatus capable of setting more sheets and making the apparatus thin.

In one aspect of the disclosure, a sheet conveying device comprises: a conveyor configured to convey a sheet along a predetermined conveyance path; and a feeder unit configured to support the sheet to be fed to the conveyor, wherein the conveyor comprises: a first guide part configured to guide the sheet, which is conveyed from a vicinity of a downstream end of the feeder unit in a conveying direction toward a further downstream side in the conveying direction, in a direction inclined at a downward gradient; a second guide part configured to guide the sheet, which is conveyed from a vicinity of a downstream end of the first guide part in the conveying direction toward a further downstream side in the conveying direction, in a direction inclined at an upward gradient; a suction roller, which is arranged at the first guide part, and which is configured to convey the sheet supported by the feeder unit toward the downstream side in the conveying direction; and a first conveyance roller, which is arranged at the second guide part, and which is configured to separate the sheet conveyed by the suction roller one at a time and to convey the sheet toward the downstream side in the conveying direction.

In another aspect of the disclosure, a sheet conveying device comprises: a conveyor configured to convey a sheet along a predetermined conveyance path; wherein the conveyor comprises: a first guide part configured to guide the sheet, which is conveyed from an upstream in a conveying direction toward a further downstream side in the conveying direction, in a direction inclined at a downward gradient; a second guide part configured to guide the sheet, which is conveyed from a vicinity of a downstream end of the first guide part in the conveying direction toward a further downstream side in the conveying direction, in a direction inclined at an upward gradient; a third guide part configured to guide the sheet, which is conveyed from a vicinity of a downstream end of the second guide part in the conveying direction toward a further downstream side in the conveying direction, in a direction of curving the sheet in a guiding direction on the second guide part; a fourth guide part configured to guide the sheet, which is conveyed from a vicinity of a downstream end of the third guide part in the conveying direction toward a further downstream side in the conveying direction, in a direction inclined at a downward gradient; a fifth guide part configured to guide the sheet, which is conveyed from a vicinity of a downstream end of the fourth guide part in the conveying direction toward a further downstream side in the conveying direction, in a direction inclined at an upward gradient; a suction roller, which is arranged at the first guide part, and which is configured to convey the sheet supported by the feeder unit toward the downstream side in the conveying direction; and a first conveyance roller, which is arranged at the second guide part, and which is configured to separate the sheet conveyed by the suction roller one at a time and to convey the sheet toward the downstream side in the conveying direction, wherein the second guide part and the fourth guide part configure the conveyance path on which sheet guiding directions of the second guide part and the fourth guide part are substantially parallel, wherein the first guide part and the fifth guide part configure the conveyance path on which sheet guiding directions of the first guide part and the fifth guide part are substantially parallel.

In still another aspect of the disclosure, an image reading apparatus comprises: a conveyor configured to convey a sheet along a predetermined conveyance path; a feeder unit configured to support the sheet to be fed to the conveyor; a discharge unit configured to support the sheet discharged from the conveyor; and a reading unit configured to read an image of the sheet being conveyed by the conveyor, wherein the conveyor comprises: a first guide part configured to guide the sheet, which is conveyed from a vicinity of a downstream end of the feeder unit in a conveying direction toward a further downstream side in the conveying direction, in a direction inclined at a downward gradient; a second guide part configured to guide the sheet, which is conveyed from a vicinity of a downstream end of the first guide part in the conveying direction toward a further downstream side in the conveying direction, in a direction inclined at an upward gradient; a suction roller, which is arranged at the first guide part, and which is configured to convey the sheet supported by the feeder unit toward the downstream side in the conveying direction; and a first conveyance roller, which is arranged at the second guide part, and which is configured to separate the sheet conveyed by the suction roller one at a time and to convey the sheet toward the downstream side in the conveying direction.

BRIEF DESCRIPTION OF THE DRAWINGS

The present disclosure is illustrated, and not limited, by way of example by the accompanying figures in which like reference numerals indicate similar elements.

DETAILED DESCRIPTION

Hereinafter, an image reading apparatus will be described in detail with reference to an illustrative embodiment.

(1) Configuration of Multi-Function Device

Figure 1:
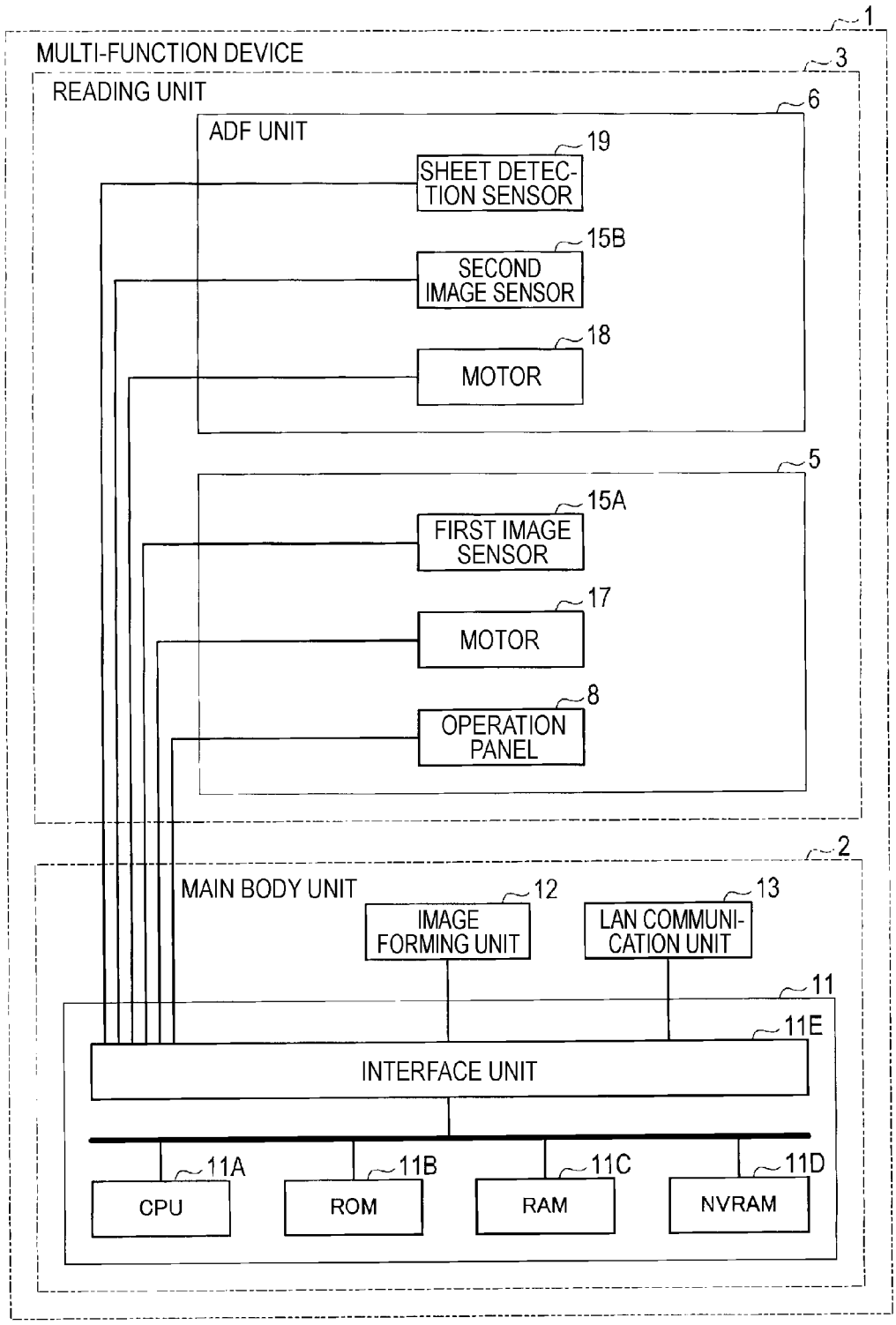
FIG. 1 is a block diagram showing a configuration of a multi-function device.

A multi-function device 1 shown in FIG. 1 has a configuration corresponding to an example of the above-described image reading apparatus. Incidentally, in below descriptions, respective directions of upper, lower, left, right, front and rear are denoted in the drawings (FIGS. 2 to 5) so as to simply describe relative positional relations of respective units configuring the multi-function device 1 and the descriptions are made using the respective directions.

As shown in FIG. 1, the multi-function device 1 (which is one example of an image reading apparatus) has a main body unit 2 and a reading unit 3. An upper surface of the main body unit 2 is formed with an opening (not shown). The reading unit 3 is mounted to an upper part of the main body unit 2 and is configured to be displaceable between a closed position and an opened position. When the reading unit 3 is located at the closed position, the opening of the main body unit 2 is closed by the reading unit 3. When the reading unit 3 is located at the opened position, the opening of the main body unit 2 is opened. Incidentally, the maintenance and the like of the components accommodated in the main body unit 2 are performed through the opening.

Figure 2A:
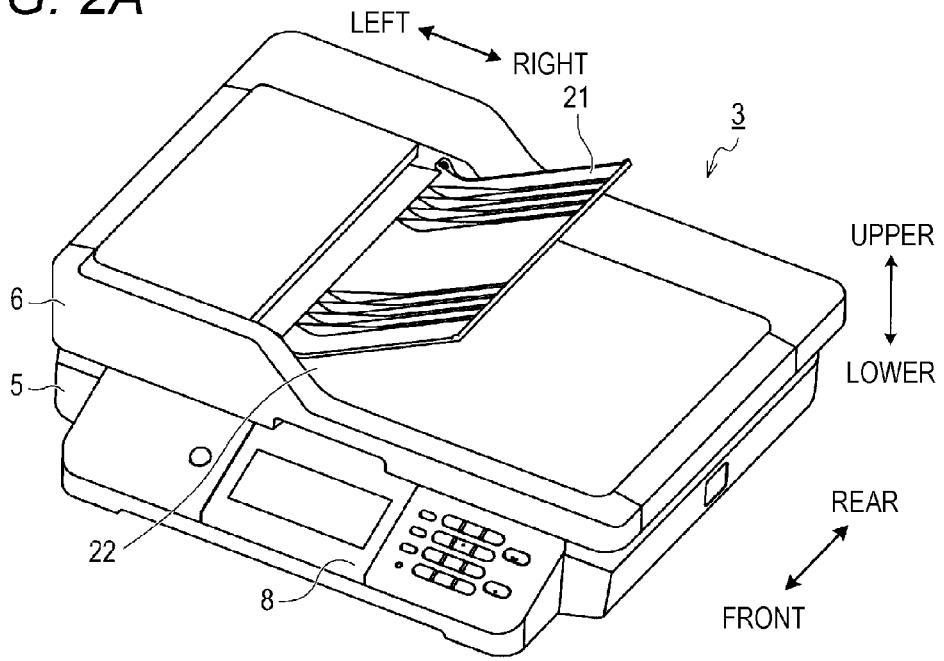
FIG. 2A is a perspective view illustrating a reading unit of which an ADF unit is located at a closed position.
Figure 2B:
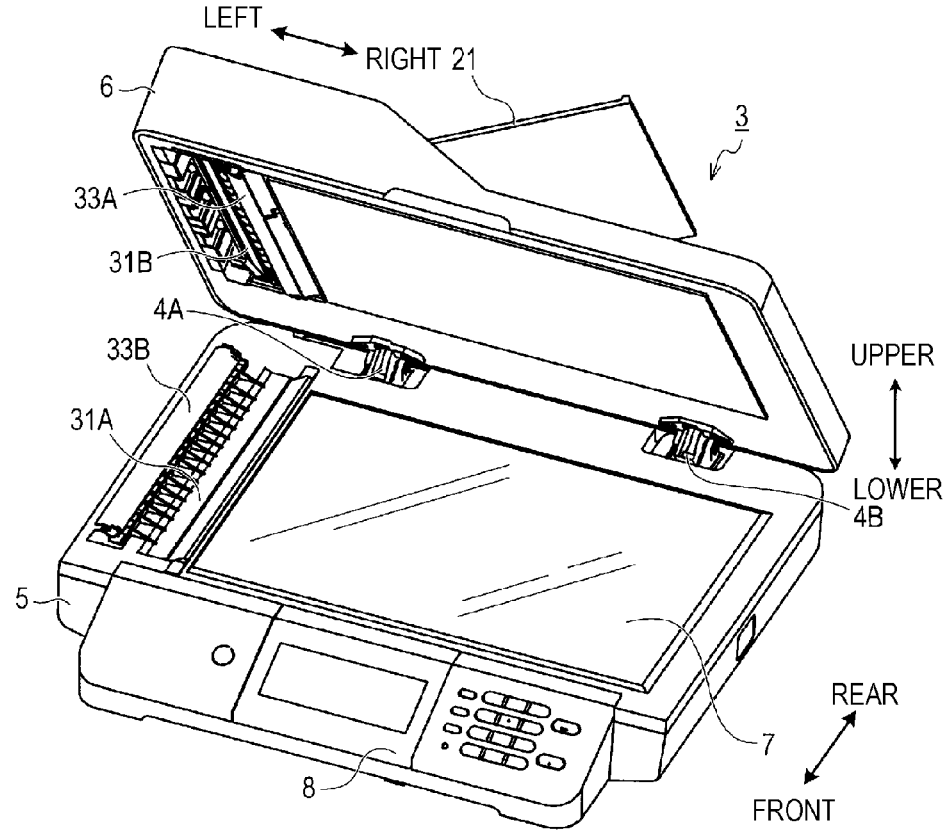
FIG. 2B is a perspective view illustrating the reading unit of which the ADF unit is located at an opened position.

The reading unit 3 has an FB unit 5 (which is one example of a first unit) and an ADF unit 6 (which is one example of a second unit). As shown in FIGS. 2A and 2B, the ADF unit 6 is mounted to the FB unit 5 through hinge parts 4A, 4B and is configured to be displaceable between the closed position (refer to FIG. 2A) and the opened position (refer to FIG. 2B).

A platen 7 for FB and the like are arranged on an upper surface of the FB unit 5. In this illustrative embodiment, the platen 7 for FB is configured by a glass plate. When the ADF unit 6 is located at the closed position (refer to FIG. 2A), an upper surface (which is one example of a support surface) of the platen 7 for FB is covered by the ADF unit 6. Also, when the ADF unit 6 is located at the opened position (refer to FIG. 2B), the upper surface of the platen 7 for FB is exposed.

A front side of the FB unit 5 is provided with an operation panel 8 that is configured to be operated by a user. The operation panel 8 is provided with an input device (for example, a touch panel, and a variety of buttons and switches), which is operated when the user inputs various commands to the multi-function device 1, and an output device (for example, a liquid crystal monitor device) for notifying the user of operation states of the multi-function device 1 and the like.

As shown in FIG. 1, the main body unit 2 has a control unit 11. The control unit 11 has a CPU 11A, a ROM 11B, a RAM 11C, an NVRAM 11D, an interface unit 11E and the like, which are well known. The CPU 11A is configured to execute predetermined processing, in response to a control program stored in the ROM 11B or RAM 11C. Thereby, the control on the respective units of the multi-function device 1 is executed.

As a control target of the control unit 11, not only the operation panel 8 but also an image forming unit 12, a LAN communication unit 13, a first image sensor 15A (which is one example of a first reading unit), a second image sensor 15B (which is one example of a second reading unit), a motor 17, a motor 18, a sheet detection sensor 19 and the like are provided. The image forming unit 12 and the LAN communication unit 13 are provided for the main body unit 2. The operation panel 8, the first image sensor 15A and the motor 17 are provided for the FB unit 5. The second image sensor 15B, the motor 18 and the sheet detection sensor 19 are provided for the ADF unit 6.

The image forming unit 12 is configured to form an image on a recording medium such as a cut sheet by an electro photographic or inkjet method. The LAN communication unit 13 is configured by a communication interface device corresponding to wireless LAN and a communication interface device corresponding to wired LAN.

In this illustrative embodiment, both the first image sensor 15A and the second image sensor 15B are contact image sensors (CISs). The motor 17 is a driving source configured to move the first image sensor 15A along the platen 7 for FB. The motor 18 is a driving source configured to convey the sheet in the ADF unit 6. The sheet detection sensor 19 is a sensor configured to detect that a tip or rear end of the sheet in a conveying direction, which is being conveyed in the ADF unit 6, has passed through a predetermined detection position.

In this illustrative embodiment, as the sheet detection sensor 19, a contact type sensor configured to switch between on and off states depending on whether the sheet being conveyed is contacted thereto is adopted. However, the contact type sensor is arbitrarily adopted. That is, a non-contact type sensor capable of detecting that the tip or rear end of the sheet in the conveying direction has passed through a predetermined detection position may also be adopted. For example, an optical sensor capable of detecting whether the sheet being conveyed is at a light path interruption state, an optical sensor capable of detecting whether light is reflected by the sheet being conveyed, and the like may be used.

(2) Details of Structure of Reading Unit

Figure 3:
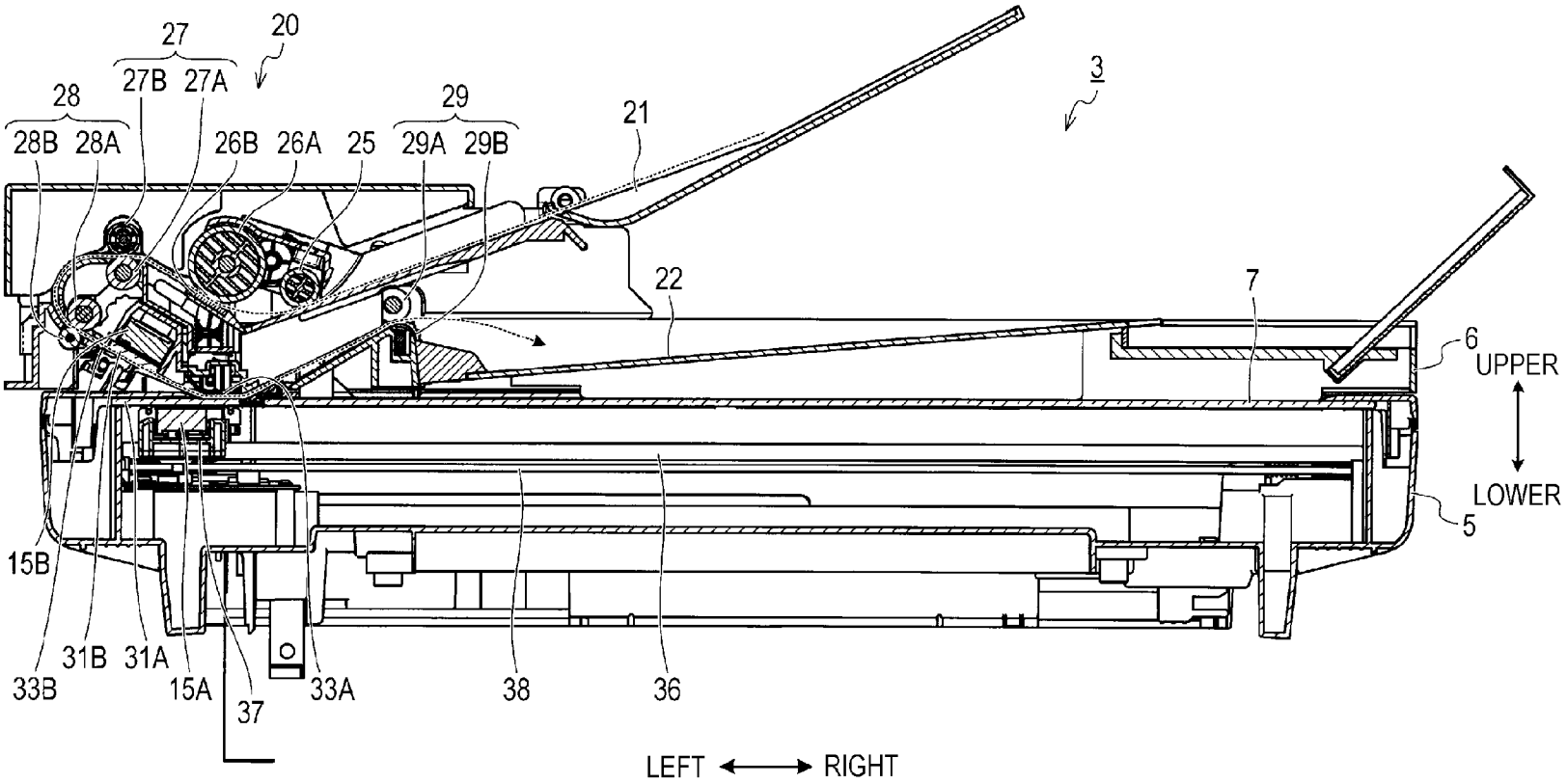
FIG. 3 is a longitudinal sectional view of the reading unit.

As shown in FIG. 3, the ADF unit 6 of the reading unit 3 has a conveyor 20 configured to convey the sheet along a predetermined conveyance path (refer to the path shown with the dotted line in FIG. 3). A feeder unit 21 configured to support a sheet to be fed to the conveyor 20 is provided at an upstream side of the conveyor 20 in the conveying direction. A discharge unit 22 configured to support the sheet discharged from the conveyor 20 is provided at a downstream side of the conveyor 20 in the conveying direction.

Figure 4:
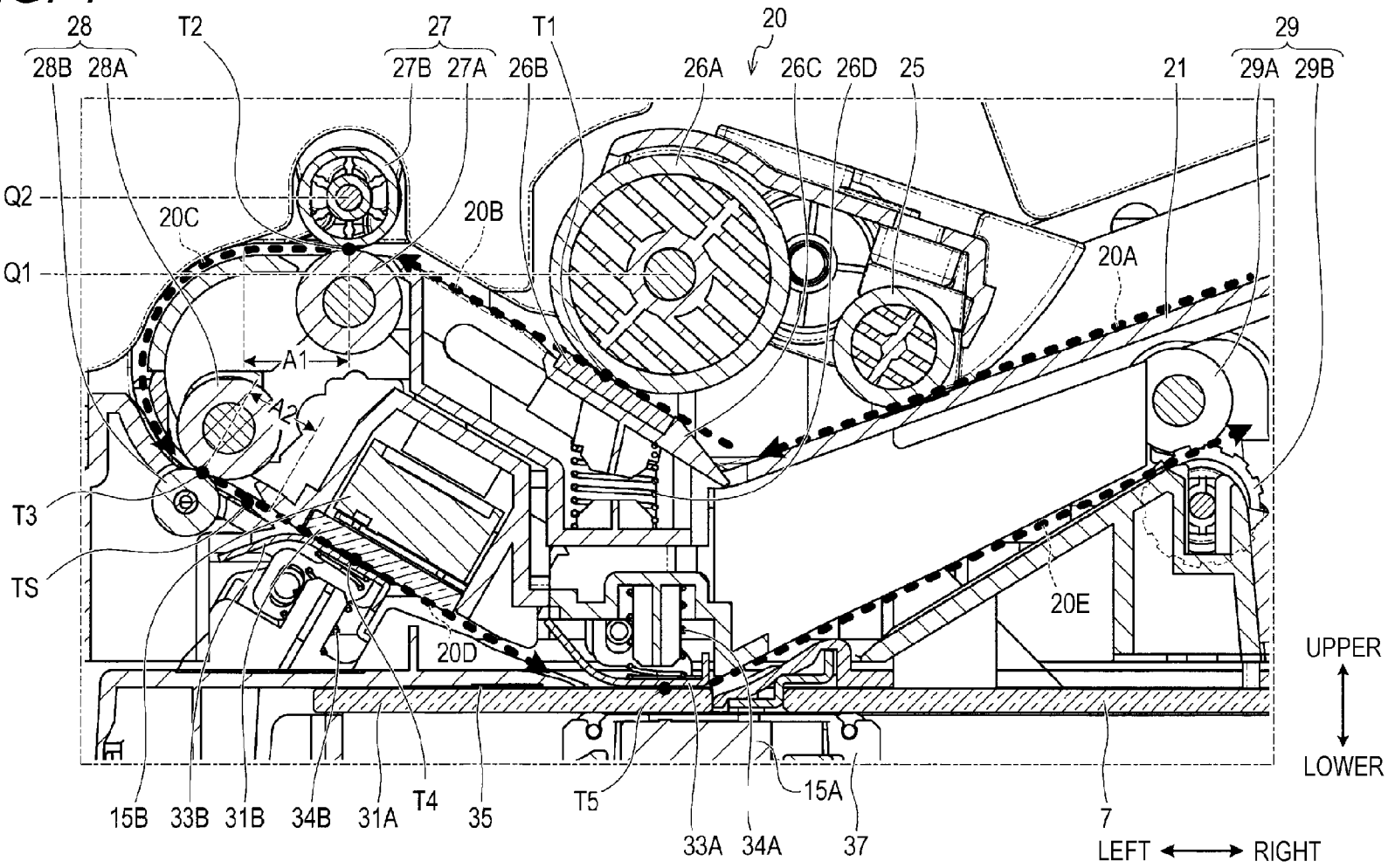
FIG. 4 is a longitudinal sectional view in which a vicinity of a conveyor is shown with being enlarged.

As shown in FIG. 3, the conveyor 20 has a suction roller 25, a first conveyance roller 26A, a separation piece 26B, a pair of second conveyance rollers 27 (a second conveyance roller 27A and a pinch roller 27B), a pair of third conveyance rollers 28 (a third conveyance roller 28A and a pinch roller 28B), a pair of fourth conveyance rollers 29 (a fourth conveyance roller 29A and a pinch roller 29B), and the like. FIG. 3 is a longitudinal sectional view of a cut surface orthogonal to an axis line becoming a rotation center of the roller group, and FIG. 4 is a longitudinal sectional view in which the roller group shown in FIG. 3 is shown with being enlarged. The conveyor 20 comprises the roller group and a member for demarcating the conveyance path. Thereby, the conveyor 20 is formed with the conveyance path from a first guide part 20A to a fifth guide part 20E via a second guide part 20B, a third guide part 20C and a fourth guide part 20D, as shown in FIG. 4.

Incidentally, the upper-lower direction described in this illustrative embodiment coincides with a direction orthogonal to the upper surface (support surface) of the platen 7 for FB. Also, the front-rear direction described in this illustrative embodiment coincides with a direction parallel with an axis line becoming a rotation center of the first conveyance roller 26A. Also, the left-right direction described in this illustrative embodiment coincides with a direction orthogonal to the axis line becoming the rotation center of the first conveyance roller 26A and parallel with the upper surface (support surface) of the platen 7 for FB.

The first guide part 20A is configured to guide the sheet, which is conveyed from a vicinity of a downstream end of the feeder unit 21 in the conveying direction toward a further downstream side in the conveying direction, in a direction inclined at a downward gradient. The second guide part 20B is configured to guide the sheet, which is conveyed from a vicinity of a downstream end of the first guide part 20A in the conveying direction toward a further downstream side in the conveying direction, in a direction inclined at an upward gradient. That is, the first guide part 20A and the second guide part 20B are configured to form a conveyance path having a substantial V shape, as seen from a direction (the front face side described in this illustrative embodiment) shown in FIG. 4. The third guide part 20C is configured to guide the sheet, which is conveyed from a vicinity of a downstream end of the second guide part 20B in the conveying direction toward a further downstream side in the conveying direction, in a direction of curving the sheet with respect to the guiding direction on the second guide part 20B.

The fourth guide part 20D is configured to guide the sheet, which is conveyed from a vicinity of a downstream end of the third guide part 20C in the conveying direction toward a further downstream side in the conveying direction, in the direction inclined at a downward gradient. The fifth guide part 20E is configured to guide the sheet, which is conveyed from a vicinity of a downstream end of the fourth guide part 20D in the conveying direction toward a further downstream side in the conveying direction, in a direction inclined at an upward gradient. That is, the fourth guide part 20D and the fifth guide part 20E are configured to form a conveyance path having a substantial V shape, as seen from the direction (the front face side described in this illustrative embodiment) shown in FIG. 4, like the first guide part 20A and the second guide part 20B.

In this way, both of a pair of the first guide part 20A and second guide part 20B and a pair of the fourth guide part 20D and fifth guide part 20E form the conveyance path having a substantial V shape, respectively. For this reason, the entire conveyance path extending from the first guide part 20A to the fifth guide part 20E also has a substantial V shape, as seen from the direction (the front face side described in this illustrative embodiment) shown in FIG. 4.

The suction roller 25 is disposed to face the first guide part 20A and is configured to convey the sheet supported by the feeder unit 21 toward the downstream side in the conveying direction. The first conveyance roller 26A and the separation piece 26B are disposed to face each other with the conveyance path defined by the second guide part 20B being interposed therebetween. The first conveyance roller 26A and the separation piece 26B are configured to separate the sheet fed from the feeder unit 21 one at a time at a first position T1 on the conveyance path and the convey the sheet toward the downstream side in the conveying direction. The first position T1 is a nip position between the first conveyance roller 26A and the separation piece 26B, and which will also be referred to as a nip position T1 hereinafter.

The separation piece 26B is held by a separation piece holder 26C (refer to FIG. 4). The separation piece holder 26C is swingably mounted to a structure such as a frame arranged in the surrounding thereof and is urged toward the first conveyance roller 26A by a separation piece urging member 26D (refer to FIG. 4). At this state, the separation piece 26B is arranged to face the first conveyance roller 26A in a direction inclined at an upward gradient toward the downstream side in the conveying direction, at a state where a surface of the separation piece 26B contacting the sheet is inclined relative to the upper surface (the support surface) of the platen 7 for FB. Thereby, the separation piece 26B configures a part of the second guide part 20B.

The pair of second conveyance rollers 27 is provided at a boundary between the second guide part 20B and the third guide part 20C and is configured to sandwich the sheet, which is conveyed from the upstream side in the conveying direction, at a second position T2 on the conveyance path and to convey the sheet toward the downstream side in the conveying direction. The boundary between the second guide part 20B and the third guide part 20C may be located around an upstream side of the third guide part 20C in the conveying direction or around a downstream side of the second guide part 20B in the conveying direction. The second position T2 is a nip position between the second conveyance roller 27A and the pinch roller 27B, and which will also be referred to as a nip position T2 hereinafter. The pair of third conveyance rollers 28 is provided at a boundary between the third guide part 20C and the fourth guide part 20D and is configured to sandwich the sheet, which is conveyed from the upstream side in the conveying direction, at a third position T3 on the conveyance path and to convey the sheet toward the downstream side in the conveying direction. The boundary between the third guide part 20C and the fourth guide part 20D may be located around an upstream side of the fourth guide part 20D in the conveying direction or around a downstream side of the third guide part 20C in the conveying direction. The third position T3 is a nip position between the third conveyance roller 28A and the pinch roller 28B, and which will also be referred to as a nip position T3 hereinafter. The pair of fourth conveyance rollers 29 is provided at a downstream end of the fifth guide part 20E in the conveying direction and is configured to sandwich the sheet, which is conveyed from the upstream side in the conveying direction, by the fourth conveyance roller 29A and the pinch roller 29B and to discharge the sheet to the discharge unit 22.

A first area A1 of the third guide part 20C within a range of a predetermined distance from the pair of second conveyance rollers 27 to a downstream side in the conveying direction is configured as a path along which a part of the sheet being guided along the first area A1 may be guided as planar without being bent. Also, a second area A2 of the fourth guide part 20D within a range of a predetermined distance from the pair of third conveyance rollers 28 to a downstream side in the conveying direction is configured as a path along which a part of the sheet being guided along the second area A2 may be guided as planar without being bent.

Incidentally, it is arbitrary whether contact portions of the first area A1 and the second area A2, which are contacted to the sheet, are planar or not, inasmuch as the contact portions have a shape capable of guiding a part of the sheet while keeping it planar. For example, the contact portion may be formed to be planar. However, tips of a plurality of ribs arranged in a line may be configured as the contact portions with the sheet and the tips of the ribs may be configured to contact the sheet and to guide a part of the sheet while keeping it planar.

A first platen for ADF 31A (which is one example of a first contact part) and a first pressing member 33A are provided at both sides of a fifth position T5, which is located at a boundary between the fourth guide part 20D and the fifth guide part 20E, with the conveyance path being interposed therebetween. Also, a second platen for ADF 31B (which is one example of a second contact part) and a second pressing member 33B (which is one example of a pressing member) are provided at both sides of a fourth position T4 on the fourth guide part 20D with the conveyance path being interposed therebetween. The fourth guide part 20D is configured to guide the sheet being conveyed from a third position T3 toward the fifth position T5 in a direction inclined at a downward gradient (which is one example of an inclination guide part). The second image sensor 15B and the second platen for ADF 31B are arranged at the fourth guide part 20D with being inclined relative to the upper surface (support surface) of the platen for FB 7.

The first platen for ADF 31A and the second pressing member 33B are arranged at the FB unit 5-side, and the second platen for ADF 31B and the first pressing member 33A are arranged at the ADF unit 6-side. For this reason, when the ADF unit 6 is located at the opened position (refer to FIG. 2B), the first platen for ADF 31A and the second pressing member 33B are exposed at the upper surface-side of the FB unit 5. Also, when the ADF unit 6 is located at the opened position (refer to FIG. 2B), the second platen for ADF 31B and the first pressing member 33A are exposed at the ADF unit 6.

In this illustrative embodiment, the first platen for ADF 31A and the second platen for ADF 31B are configured by glass plates and extend over a range exceeding a width of the sheet in a width direction (the front-rear direction described in this illustrative embodiment) orthogonal to the conveying direction of the sheet. The first pressing member 33A and the second pressing member 33B are made of metal or hard resin material and extend over a range exceeding the width of the sheet, like the first platen for ADF 31A and the second platen for ADF 31B.

As shown in FIG. 4, the first pressing member 33A is configured to be urged toward the first platen for ADF 31A by a first urging member 34A (a coil spring, in this illustrative embodiment). Thereby, the first pressing member 33A suppresses the sheet, which passes with contacting the upper surface of the first platen for ADF 31A, from floating from the first platen for ADF 31A. The second pressing member 33B is configured to be urged toward the second platen for ADF 31B by a second urging member 34B (a coil spring, in this illustrative embodiment). Thereby, the second pressing member 33B suppresses the sheet, which passes with contacting the upper surface of the second platen for ADF 31B, from floating from the second platen for ADF 31B.

As shown in FIG. 4, a black-white reference member 35 is provided in the vicinity of a center of the upper surface of the first platen for ADF 31A. The black-white reference member 35 is a member having white and black parts forming a predetermined pattern. When reading an image by the first image sensor 15A, the black-white reference member 35 over the first platen for ADF 31A is read in advance by the first image sensor 15A. The read data of a monochrome image is used when an origin position of the first image sensor 15A is corrected or shading correction is performed by the CPU 11A. When reading an image of the sheet being conveyed by the conveyor 20, the sheet is contacted to the first platen for ADF 31A in a right area of the black-white reference member 35 in FIG. 4. In FIG. 4, a width of the first platen for ADF 31A in the left-right direction is configured to secure an area for reading a sheet image, an area for reading the black-white reference member 35, an area for fixing the first platen for ADF 31A, and the like.

In the vicinity of a detection position TS downstream from the third position T3 and upstream from the fourth position T4 in the conveying direction, the sheet detection sensor 19 (refer to FIG. 1) capable of detecting the sheet passing the detection position TS is arranged. A roller configured to rotate with contacting the sheet is not disposed within a range downstream from the pair of third conveyance rollers 28 and upstream from the fifth position T5 in the conveying direction and the sheet is conveyed substantially straight from the third position T3 to the fifth position T5. For this reason, the conveying speed of the sheet is little changed in a zone from the third position T3 to the fifth position T5, so that it is possible to detect timings at which the tip or rear end of the sheet in the conveying direction reaches the fourth position T4 and the fifth position T5, at the single detection position TS.

As shown in FIG. 3, the FB unit 5 comprises a guide shaft 36, a carriage 37, a toothed belt 38 and the like. The guide shaft 36 is a metallic round bar and extends in the left-right direction described in this illustrative embodiment in parallel with lower surfaces of the first platen for ADF 31A and platen for FB 7 ranging from the below of the first platen for ADF 31A to the below of the platen for FB 7.

The carriage 37 is slidably mounted to the guide shaft 36 and is supported to be reciprocally movable in the extension direction (the left-right direction described in this illustrative embodiment) of the guide shaft 36 along the guide shaft 36. The carriage 37 is coupled to the endless toothed belt 38 and is reciprocally moved in the left-right direction described in this illustrative embodiment, in conformity to circulation of the toothed belt 38.

The first image sensor 15A is mounted on the carriage 37 and is thus moved together with the carriage 37 when the carriage 37 is moved. Incidentally, the first image sensor 15A is configured to be urged toward the first platen for ADF 31A and the platen for FB 7 by an urging member (a coil spring, in this illustrative embodiment), so that a distance between the first image sensor 15A and the first platen for ADF 31A and platen for FB 7 is kept constant. The second image sensor 15B is arranged at a predetermined position and is configured not to move from the position. The second image sensor 15B is closely contacted to the second platen for ADF 31B by its own weight, so that a distance between the second image sensor 15B and the second platen for ADF 31B is kept constant. Incidentally, an urging member configured to urge the second image sensor 15B toward the second platen for ADF 31B may also be provided.

A plurality of reading elements provided for the first image sensor 15A and the second image sensor 15B is arranged in the front-rear direction described in this illustrative embodiment. When reading an image of the sheet placed on the upper surface of the platen for FB 7, the first image sensor 15A reads the image with moving together with the carriage 37.

In a case of reading an image of the sheet being conveyed by the conveyor 20, the first image sensor 15A is stopped at a stop position that is below the first pressing member 33A and the first platen for ADF 31A. At this state, the first image sensor 15A is configured to read an image of a first surface of the sheet passing with contacting the first platen for ADF 31A at the fifth position T5 (hereinafter, also referred to as first reading position T5) on the conveyance path. The second image sensor 15B is configured to read an image of a second surface of the sheet passing with contacting the second platen for ADF 31B at the fourth position T4 (hereinafter, also referred to as second reading position T4) on the conveyance path. Incidentally, as described above, in this illustrative embodiment, it is possible to detect the timings at which the sheet reaches the fourth position T4 and the fifth position T5 by the single sheet detection sensor 19. For this reason, the CPU 11A may control the reading start timings at the second reading position T4 and the first reading position T5, based on a detection signal from the sheet detection sensor 19.

In the multi-function device 1, the first guide part 20A and the second guide part 20B configure the substantially V-shaped conveyance path in which a boundary part of both the guide parts is the lowest position in the upper-lower direction described in this illustrative embodiment. Also, the second guide part 20B and the fourth guide part 20D configure the conveyance path on which the sheet guiding directions of the respective guide parts are substantially parallel, and the first guide part 20A and the fifth guide part 20E configure the conveyance path on which the sheet guiding directions of the respective guide parts are substantially parallel. Incidentally, the description "substantially parallel" in this illustrative embodiment includes not only a configuration where an angle between both the guiding directions is 0° but also a configuration where an angle between both the guiding directions has a slight inclination (for example, an angle between both the guiding directions is 10° or smaller, preferably 5° or smaller), which may be considered to be substantially parallel.

When the above conveyance path is configured, it is possible to arrange the second guide part 20B and the fourth guide part 20D with being closer to each other, as compared to a configuration where the second guide part 20B and the fourth guide part 20D are not made to be parallel with each other. Here, it is necessary to arrange more configurations such as the separation piece 26B, the separation piece holder 26C, the separation piece urging member 26D and the second image sensor 15B in a space between the second guide part 20B and the fourth guide part 20D. Also, when conveying the sheet, in order to implement the favorable conveyance, there is also a limitation on an angle that may be set as the conveyance path. After considering the corresponding elements, when a distance between the second guide part 20B and the fourth guide part 20D and a parallel degree are set as described in this illustrative embodiment, it is possible to make the apparatus small without degrading the sheet conveying performance. For example, a configuration may be considered in which the respective guide parts are formed to have an uneven shape in conformity to a shape of the configuration to be arranged between the second guide part 20B and the fourth guide part 20D and the second guide part 20B and the fourth guide part 20D are thus arranged to be closer to each other. In this case, however, the sheet may not be smoothly conveyed on each guide part. In order to avoid the problem, it is effective to configure the conveyance path, on which the sheet conveying directions are substantially parallel, by the second guide part 20B and the fourth guide part 20D.

Likewise, it is possible to arrange the first guide part 20A and the fifth guide part 20E with being closer to each other, as compared to a configuration where the first guide part 20A and the fifth guide part 20E are not made to be parallel with each other. Also for the first guide part 20A and the fifth guide part 20E, after considering the configurations to be arranged therebetween and the inclination angle suitable for the sheet conveyance, when a distance between first guide part 20A and the fifth guide part 20E and a parallel degree are set as described in this illustrative embodiment, it is possible to make the structure between the first guide part 20A and the fifth guide part 20E thin.

Further, the conveyance path configured by the first guide part 20A, the second guide part 20B, the third guide part 20C, the fourth guide part 20D and the fifth guide part 20E forms the conveyance path having the substantial V-shape as a whole, and the first conveyance roller 26A is arranged in an inner-side space of the V shape.

A height position of a downstream end of the second guide part 20B in the conveying direction is determined, considering securing the conveyance path (for example, the third guide part 20C and the fourth guide part 20D) further extending from the height position toward the downstream side in the conveying direction. For this reason, when the conveyance path having the substantial V-shape is configured on the basis of the height position of the downstream end of the second guide part 20B in the conveying direction, it is possible to set a boundary position (the lowest position of the conveyance path having the substantial V-shape) between the first guide part 20A and the second guide part 20B at a lower position, as compared to a configuration where the second guide part 20B is horizontal or is inclined at a downward gradient. When the boundary position between the first guide part 20A and the second guide part 20B becomes lower, it is possible to lower the mounting position of the first conveyance roller 26A as much as that.

Therefore, according to the above structure, it is possible to arrange the first conveyance roller 26A at the lower position. Thereby, it is possible to make the structure adjacent to the first conveyance roller 26A thin. Also, when a part of the conveyance path configured by the second guide part 20B is configured at the lower position, it is possible to adopt the first conveyance roller 26A having a larger diameter as much as that. Therefore, it is possible to increase the diameter of the first conveyance roller 26A, thereby increasing the number of sheets to be settable in the feeder unit 21. Also in this case, it is possible to suppress the increase in the height size of the structure adjacent to the first conveyance roller 26A.

Also, when mounting the second image sensor 15B, the platen for second ADF 31B, the second pressing member 33B and the like, the fourth guide part 20D on which the corresponding members are mounted can secure a path length necessary for the mounting. In case of securing an equivalent path length, when the conveyance path having the substantial V shape (the path on the fourth guide part 20D inclined at a downward gradient) is configured as described above, a mounting range occupied by the conveyance path having the substantial V shape in the horizontal direction is reduced, as compared to a mounting range occupied by a horizontal conveyance path in the horizontal direction. Therefore, when the conveyance path having the substantial V shape is configured as described above, it is possible to easily increase the diameter of the first conveyance roller 26A, and to make the path length of the conveyance path more compact in the horizontal direction (the left-right direction described in this illustrative embodiment) of the conveyance path, even if it is equivalent.

Also, in the multi-function device 1, on the path along which the sheet is conveyed in the direction of curving the sheet by the third guide part 20C, the pair of second conveyance rollers 27 and the pair of third conveyance rollers 28 are respectively provided in the vicinities of the upstream and downstream ends of the corresponding path. For this reason, it is possible to individually adjust the nip positions, which are respectively formed by the pair of second conveyance rollers 27 and the pair of third conveyance rollers 28, and the sheet conveying directions at the nip positions, in conformity to the conveyance path. Therefore, it is possible to more freely set the shape of the conveyance path and to more easily configure the conveyance path of which height size is suppressed, as compared to a configuration where a single conveyance roller is provided at an inner periphery-side of the third guide part 20C.

Also, in the multi-function device 1, as shown in FIG. 4, a position Q1 of a rotation center of the first conveyance roller 26A is lower than a position Q2 of a rotation center of the pinch roller 27B. For this reason, as compared to a configuration where the rotation center of the first conveyance roller 26A is higher than the rotation center of the pinch roller 27B, when the diameter of the first conveyance roller 26A is the same as that of such a comparison configuration, it is possible to set the upper end position of the first conveyance roller 26A at the lower position, thereby making the structure adjacent to the first conveyance roller 26A thin. Also, when the upper end position of the first conveyance roller 26A is equivalent, it is possible to increase the diameter of the first conveyance roller 26A, thereby improving the separation performance of the first conveyance roller 26A, as compared to a configuration where the rotation center of the first conveyance roller 26A is higher than the rotation center of the pinch roller 27B.

Also, according to the multi-function device 1, in the first area A1 or second area A2, a part of the sheet being guided along each area is guided without being bent. For this reason, in contrast with a configuration where a part of the sheet is bent at a place corresponding to the first area A1 or second area A2, the useless stress is difficult to be applied to the sheet between the corresponding place and the pair of second conveyance rollers 27 or pair of third conveyance rollers 28. Therefore, it is possible to smoothly convey the sheet by the pair of second conveyance rollers 27 or pair of third conveyance rollers 28 and to prevent the noise from being generated, which is caused due to the contact between the sheet and the guide surface defining the conveyance path, as the sheet is conveyed.

(3) Modifications

Although the image reading apparatus has been described with reference to the specific illustrative embodiment, the present invention is not limited to the above illustrative embodiment and may be variously implemented without departing from the technical spirit of the present invention.

For example, in the above illustrative embodiment, the image reading apparatus configured as the multi-function device has been exemplified as the image reading apparatus of the present invention. However, it is arbitrary whether the image reading apparatus is configured as the multi-function device, and the configuration of the present invention may be adopted for an image reading apparatus having a single function, a copier, a facsimile apparatus and the like.

What is claimed is:

1. A sheet conveying device comprising:

a conveyor configured to convey a sheet along a predetermined conveyance path; and a feeder configured to support the sheet to be fed to the conveyor, wherein the conveyor comprises:

a first guide surface configured to guide the sheet, which is conveyed from a vicinity of a downstream end of the feeder in a conveying direction toward a further downstream side in the conveying direction, the first guide surface having a downstream end and an upstream end, wherein the first guide surface extends a downward gradient such that the downstream end is lower than the upstream end;

a second guide surface configured to guide the sheet, which is conveyed from a vicinity of the downstream end of the first guide surface in the conveying direction toward a further downstream side in the conveying direction, the second guide surface having an upstream end and a downstream end, wherein the second guide surface extends at an upward gradient such that the upstream end is lower than the downstream end, and wherein an intersection of a first virtual plane including the first guide surface and a second virtual plane including the second guide surface form a specific portion, the specific portion being the lowest position in the conveyance path configured by the first guide surface and the second guide surface in an upper-lower direction;

a third guide surface configured to guide the sheet, which is conveyed from a vicinity of a downstream end of the second guide surface in the conveying direction toward a further downstream side in the conveying direction, in a direction of curving the sheet in a guiding direction on the second guide surface;

a fourth guide surface configured to guide the sheet, which is conveyed from a vicinity of a downstream end of the third guide surface in the conveying direction toward a further downstream side in the conveying direction, in a direction inclined at a downward gradient, the fourth guide surface being provided with a reading sensor configured to read an image of the sheet with being inclined relative to a support surface; and a first conveyance roller disposed at a position facing the second guide surface, the first conveyance roller being configured to rotate about a first axis and separate the sheet fed from the feeder one at a time and to convey the sheet toward the downstream side in the conveying direction, wherein the first axis is positioned at the downstream side of the specific portion in the conveying direction, wherein with respect to a direction orthogonal to the support surface, a position of the specific portion overlaps with a position of the reading sensor when seen from a direction parallel to the first axis of the first conveyance roller.

2. The sheet conveying device according to claim 1, further comprising:

a suction roller disposed at a position facing the first guide surface, the suction roller being configured to convey the sheet supported by the feeder toward the first conveyance roller.

3. The sheet conveying device according to claim 2, further comprising a roller holder rotatable around the first axis of the first conveyance roller, the roller holder rotatably holding the suction roller.

4. The sheet conveying device according to claim 1, wherein a third virtual plane extending in the upper-lower direction and passing the specific portion crosses the first conveyance roller.

5. The sheet conveying device according to claim 1, wherein the conveyor further comprises:

a separation piece configured to separate the sheet one at a time in cooperation with the first conveyance roller; and a holder configured to hold the separation piece, and wherein the separation piece is arranged in a direction in which a contact surface thereof to the sheet is inclined at an upward gradient toward the downstream side in the conveying direction, the contact surface configuring a part of the second guide surface.

6. The sheet conveying device according to claim 1, wherein the second guide surface and the fourth guide surface configure the conveyance path on which sheet guiding directions of the second guide surface and the fourth guide surface are substantially parallel.

7. The sheet conveying device according to claim 6, further comprising:

a discharger configured to support the sheet discharged from the conveyor, wherein the conveyor further comprises a fifth guide surface configured to guide the sheet, which is conveyed from a vicinity of a downstream end of the fourth guide surface in the conveying direction toward a further downstream side in the conveying direction, in a direction inclined at an upward gradient, wherein the first guide surface and the fifth guide surface configure the conveyance path on which sheet guiding directions of the first guide surface and the fifth guide surface are substantially parallel, and wherein the sheet conveyed by the fifth guide surface is discharged to the discharger.

8. The sheet conveying device according to claim 7, wherein the conveyor further comprises a pair of discharge rollers configured to discharge the sheet toward the discharger, and wherein a rotation shaft of one of the pair of discharge rollers facing the fifth guide surface from the above is located at a position that is upper than the specific portion.

9. The sheet conveying device according to claim 6, wherein the conveyor further comprises:

a pair of second conveyance rollers provided in a vicinity of an upstream end of the third guide surface in the conveying direction and configured to convey the sheet toward the third guide surface; and a pair of third conveyance rollers provided in the vicinity of the downstream end of the third guide surface in the conveying direction and configured to convey the sheet toward the fourth guide surface.

10. The sheet conveying device according to claim 9, wherein the pair of second conveyance rollers comprises:

a second conveyance roller configured to rotate; and a pinch roller urged toward the second conveyance roller above the second conveyance roller, and wherein a rotation center of the first conveyance roller is located at a position that is lower than a position of a rotation center of the pinch roller.

* * * * *